US005312725A

United States Patent [19]

Araki et al.

[11] Patent Number: 5,312,725

[45] Date of Patent: May 17, 1994

[54] SILVER HALIDE COLOR PHOTOGRAPHIC LIGHT-SENSITIVE MATERIAL IN ROLL FORM

[75] Inventors: Hiromitsu Araki; Tohru Kobayashi; Eiichi Ueda, all of Tokyo, Japan

[73] Assignee: Konica Corporation, Tokyo, Japan

[21] Appl. No.: 41,683

[22] Filed: Apr. 1, 1993

[30] Foreign Application Priority Data

Apr. 20, 1992 [JP] Japan ..... 4-99352

[51] Int. Cl.[5] ..... G03C 1/76

[52] U.S. Cl. ..... 430/523; 430/501; 430/539; 430/930; 430/533; 430/621

[58] Field of Search ..... 430/501, 539, 930, 533, 430/523, 621

[56] References Cited

U.S. PATENT DOCUMENTS 3,926,869 12/1975 Horie et al. ..... 430/621
4,600,687 7/1986 Nakamura et al. ..... 430/523
4,668,616 5/1987 Okamura et al. ..... 430/621
4,751,173 6/1988 Okamura ..... 430/621
5,070,006 12/1991 Krafft et al. ..... 430/523
5,100,769 3/1992 Westfal et al. ..... 430/523

*Primary Examiner*—Charles L. Bowers, Jr.
*Assistant Examiner*—Thomas R. Neville
*Attorney, Agent, or Firm*—Jordan B. Bierman

[57] ABSTRACT

A silver halide color photographic light-sensitive material in roll form comprises a support, and provided thereon, a silver halide emulsion layer and, on the side of the support opposite the silver halide emulsion layer, a backing layer containing gelatin and a hardener, wherein the backing layer has a degree of swelling of 250% or less represented by the following equation:

$$\text{Degree of swelling} = [(A-C)/(B-C)] \times 100.$$

11 Claims, No Drawings

SILVER HALIDE COLOR PHOTOGRAPHIC LIGHT-SENSITIVE MATERIAL IN ROLL FORM

FIELD OF THE INVENTION

The present invention relates to a silver halide photographic light-sensitive material, particularly to a silver halide photographic light-sensitive material in roll form which is protected from staining itself in the developing process using a cine automatic processor and fitly loaded in a compact camera.

BACKGROUND OF THE INVENTION

Compact cameras are widely used today. And, to make these compact cameras more handy to carry, much smaller ones are desired. In various attempts to realize the further miniaturization of these compact cameras, one of the prime essentials is to reduce the space to house a photographic film.

When loaded in a compact camera, a photographic film is generally wound on a spool in roll. Therefore, to reduce the housing space for a photographic film without decreasing the number of exposures, the film itself must be made thinner. The thickness of a photographic support now in use is about 120 to 125 μm and considerably thicker than that of a light-sensitive layer (20 to 30 μm) formed on the support. Accordingly, thinning a photographic support is the most effective means for reducing the thickness of a whole photographic film.

As photographic supports used now, triacetylcellulose (occasionally abbreviated as TAC) films are the most typical. However, TAC films are poor in mechanical strength by nature; therefore, when made much thinner, TAC films become apt to cause troubles during conveyance or handling in a camera or in the developing process after photographing. Accordingly, it is not expedient to make the thickness of a TAC film support less than the thickness of a photographic support in use today.

On the other hand, polyethylene terephthalate films, which have so far been employed as films for X-ray photography or for photomechanical process in the photographic industry, are excellent in mechanical strength and, thereby, come to attract much attention as a photographic support which may enable the reduction of the thickness of a photographic film without lowering the mechanical strength. However, polyester resin films including polyethylene terephthalate films are unsuitable for photographic supports by nature, because these films are likely to cause a curl and can be hardly recovered from it once wound in roll.

However, the technique to provide a polyester resin with hydrophilicity disclosed in Japanese Pat. O.P.I. Pub. Nos. 120857/1990, 244446/1989, etc. has made possible to prevent polyester resin films from curl. Since then, active studies have been made with the aim of developing a thinner photographic film by use of a polyester resin support.

When such a polyester resin photographic support is used, a thinner photographic film can be certainly obtained; but, there arises a problem that the photographic film becomes apt to curl because of high water content of by a emulsion layer formed on one side of a support. To prevent such curl by balancing the moisture contents between the two sides, there is a method of using gelatin in a backing layer formed on the side of the support opposite to the emulsion layer.

A photographic film having gelatin in the backing layer does not curl, because the moisture contents of layers formed on the two sides of a photographic support are nearly equal to each other and, thereby, the curling property is balanced between the two sides. However, there arises another problem that the backing layer is stained with dust or foreign matters adsorbed thereon when brought into contact with a roller in the developing process using a cine automatic processor.

SUMMARY OF THE INVENTION

An object of the present invention is to solve the foregoing problem and provide a silver halide color photographic light-sensitive material in roll form which is protected from staining itself in the developing process. Another object of the present invention is to provide a silver halide color photographic light-sensitive material in roll form which is thin, free from coiling habit, and suitable for use in compact cameras.

The above objects are accomplished by a silver halide color photographic light-sensitive material in roll form comprising a support and provided thereon, a silver halide emulsion layer and, on the side of the support opposite the silver halide emulsion layer, a backing layer containing gelatin and a hardener, wherein the backing layer has a degree of swelling of 250% or less.

DETAILED DESCRIPTION OF THE INVENTION

The invention is hereinafter described in detail.

The silver halide photographic light-sensitive material according to the invention (hereinafter occasionally referred to as the light-sensitive material) has on one side of photographic support (1) at least one silver halide emulsion layer (2) and, on the other side of the support, a backing layer (3) having a specific degree of swelling (%).

Photographic Support (1)

The photographic support used in the invention can be obtained by use of a polyester film having a known subbing layer.

The polyester film is not particularly limited as long as it exhibits an adequate strength when used in a photographic support. Examples thereof include a film of copolymer polyesters such as polyethylene terephthalate, polyethylene 2,6-dinaphthalate and polypropylene terephthalate obtained by condensation polymerization between an aromatic dicarboxylic acid, such as terephthalic acid, isophthalic acid, phthalic acid or naphthalene dicarboxylic acid, and a glycol, such as ethylene glycol, 1,3-propanediol or 1,4-butanediol; and copolymer polyesters thereof.

In the embodiment of the invention, high moisture content polyesters are preferred to prevent the curl. Typical examples thereof can be seen, for example, in Japanese Pat. O.P.I. Pub. Nos. 244446/1989, 291248/1989, 298350/1989, 89045/1990, 93641/1990, 181749/1990 and 214852/1990.

When measured at 20° C. using a mixture solvent of phenol and 1,1,2,2-tetrachloroethane (60/40, by weight), the intrinsic viscosity of the polyester used in a photographic support according to the invention is preferably 0.4 to 1.0 and more preferably 0.5 to 0.8.

This photographic support may contain phosphoric acid, phosphorous acid and esters thereof as well as inorganic particles such as silica, kalion, potassium carbonate, potassium phosphate and titanium dioxide. When necessary, there may also be contained a variety of additives such as matting agents, antistatic agents, lubricants, surfactants, stabilizers, dispersants, plasticizers, UV absorbents, conductive materials, tackifiers, softening agents, fluidizing agents, thickeners and antioxidants.

Further, it is preferable for the support to contain dyes in order to prevent light piping caused by the incident light from the edge of a photographic support coated with photographic emulsion layers. Types of such dyes are not particularly limited; but, preferred are anthraquinone dyes and the like which have a good heat resistance in the film forming process.

Further, it is preferable that the photographic support be tinted gray as is seen in general light-sensitive materials. As dyes for such tinting, there can be used, singly or in combination, the dyes on the market under the trade names of SUMIPLAST (Sumitomo Chemical Co.), DIARESIN (Mitsubishi Kasei Corp.), MACROLEX (Bayer AG), etc.

The photographic support of the invention can be manufactured by conventional methods such as solid phase polymerization of a polymer prepared by melt polymerization or solution polymerization.

To be concrete, the photographic support of the invention can be manufactured, for example, by the steps of thoroughly drying the foregoing copolymer polyester, melt extruding it into a film shape through an extruder, a filter and a head each maintained within the range of 260° to 320° C., cooling the molten polymer to solid on a rotating cooling drum to obtain an unoriented film, and then heat setting the unoriented film under biaxial orientation.

The biaxial orientation is carried out by any of the following methods (A) to (C).

(A) A method of stretching an unoriented film in the longitudinal direction first and then stretching it in the lateral direction.

(B) A method of stretching an unoriented film in the lateral direction first and then stretching it in the longitudinal direction.

(C) A method of stretching an unoriented film in the longitudinal direction in a single step or multiple steps, stretching again in the longitudinal direction and then stretching it in the lateral direction.

In order to give an adequate mechanical strength and dimensional stability to the photographic support, the stretching is performed within the areal expansion rate of preferably 4 to 16 times.

The photographic support of the invention may be a single layered film or sheet prepared in the foregoing manner, or may have composite structure comprising a film or sheet formed by the foregoing method and a film or sheet of another material bonded thereon by coextrusion or lamination. The resulting photographic support is especially suited for a photographic film used in the form of rolls.

The thickness of the photographic support is usually 50 to 110 μm, preferably 60 to 100 μm and more preferably 60 to 90 μm. When the thickness exceeds 110 μm, it is difficult to provide a photographic film suitable for a miniaturized compact camera without reducing a prescribed number of exposures. On the contrary, a support having a thickness not more than 50 μm is poor in mechanical strength and can hardly be of practical use.

Silver Halide Emulsion Layer (2)

Silver halide emulsion layers can be formed by coating silver halide emulsions containing silver halides and other components, directly or indirectly on one side or both sides of a photographic support, using various coating methods.

Such silver halide emulsion layers may be formed on a photographic support, directly, or via another layer such as a hydrophilic colloid layer containing no silver halide emulsion. Further, there may also be provided a hydrophilic colloid layer as protective layer on the silver halide emulsion layers. These silver halide emulsion layers may be formed in different sensitivities; for example, these may be divided into a high speed emulsion layer and a low-speed emulsion layer. In this case, an intermediate layer may be provided between these emulsion layers; that is, an intermediate layer comprising hydrophilic colloid may be provided when necessary. In addition, there may also be provided, between a silver halide emulsion layer and a protective layer, a nonlight-sensitive hydrophilic colloid layer such as an intermediate layer, a protective layer, an antihalation layer or a backing layer.

Silver halides used in these silver halide emulsions may have any composition. Examples of usable silver halides include silver chloride, silver chlorobromide, silver chloroiodobromide, pure silver bromide and silver iodobromide.

Further, these silver halide emulsions may contain other components such as binders, sensitizing dyes, plasticizers, antistatic agents, surfactants and hardeners.

Backing Layer (3)

The backing layer can be obtained by forming at least one layer comprising a gelatin-containing backing layer composition on a photographic support opposite to the silver halide emulsion layers.

Suitable gelatins are coal-processed gelatins, acid-processed gelatins and alkali-processed gelatins. Gelatin derivatives prepared by hydrolysis or enzyme-decomposition of gelatin can also be used.

When necessary, the backing layer in the invention may further contain other conventional compounds, such as matting agents, lubricants, surfactants, hardeners, dyes, thickeners and polymer latices. Suitable examples of these matting agent, lubricant, surfactant and hardener can be seen, for example, in sections XVI, XII, XI and X of Research Disclosure No. 17643 (1978).

In the embodiment of the invention, the degree of swelling (%) of the backing layer is not more than 250%, preferably 120 to 240% and more preferably 150 to 230%. When the degree of swelling exceeds 250%, staining of a photographic support cannot be prevented.

The degree of swelling is obtained by the following equation:

$$\textit{Degree of swell} = [(A - C) / (B - C)] \times 100$$

wherein A is the weight (in grams) of 10 $cm^2$ of the photographic light sensitive material after (i) adhering water-proof tape on the backing layer, (ii) removing the silver halide emulsion layer with a bleaching agent, (iii) peeling off the water-proof tape, (iv) conditioning the resulting material at 23° C. and 55% RH for 1 day, (v) dipping the conditioned material in color developer at 3820 C. for 3 minutes, and (vi) wiping off the color developer from the material; B is the weight of the material after further conditioning at 23° C. and 55% RH for 1 day; and C is the weight of the material after removing the backing layer with a bleaching agent and further conditioning the resulting material at 23° C. and 55% RH for 1 day.

In the present invention, there is no limitation to a method of controlling the degree of swell. The typical controlling method includes controlling the amount of hardeners added to the backing layer. There is no limitation to the hardeners used so long as they reduce the degree of swell. The preferable are vinyl sulfone hardeners and s-triazine hardeners. Representative hardeners will be given below.

H-1

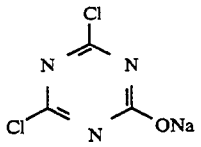

H-2 $H_2C{=}CHSO_2CH_2OCH_2SO_2CH{=}CH_2$

H-3 $H_2C{=}CHSO_2CH_2SO_2CH{=}CH_2$

H-4 $H_2C{=}CHSO_2CH_2CH(OH)CH_2SO_2CH{=}CH_2$

H-5 $H_2C{=}CHSO_2CH_2CONHCH_2NHCOCH_2SO_2CH{=}CH_2$

H-6

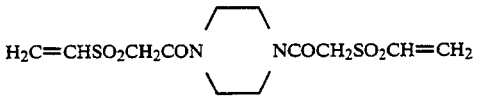

H-7

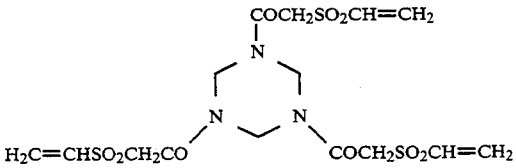

H-8 $(H_2C{=}CHSO_2CH_2)_4C$

H-9

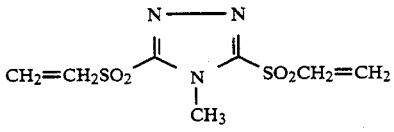

H-10

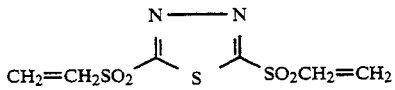

The above mentioned hardeners may be employed singly. However, two or more of them are preferably employed in combination. The amount of the hardeners is different depending upon hardening ability of hardeners used. The content of the vinyl sulfone hardeners in the backing layer is preferably 25 mg or more per 1 g of gelatin. The content of the s-triazine hardeners in the backing layer is preferably 15 mg or more per 1 g of gelatin. When two or more hardeners are employed in combination, the total content of the hardeners is preferably 20 mg or more, and more preferably 30 mg or more.

In the invention, the thickness of the backing layer is preferably 0.1 to 15 μm. When the backing layer is composed of two or more layers, the ratio of the upper layer thickness to the lower layer thickness is preferably 1:5 to 5:1. Development of Silver Halide Photographic Light-Sensitive Materials The silver halide photographic light-sensitive material of the invention can be developed by use of conventional developers described, for example, in T.H James, The Theory of the Photographic Process, Forth Edition, pp. 291–334 and Journal of the American Chemical Society, vol. 73, p. 3,100 (1951).

EXAMPLES

The invention is illustrated by the following examples in which parts are parts by weight.

EXAMPLES 1 TO 3, COMPARATIVE EXAMPLES 1 AND 2

A. Preparation of Support

A mixture of 100 parts of dimethyl terephthalate, 64 parts of ethylene glycol and 0.1 part of hydrated calcium acetate as a transesterification catalyst was transesterified in the usual manner.

To the product were added 35 wt % ethylene glycol solution of 5-sodiumsulfo-di(β-hydroxyethyl)isophthalic acid (SIP), 8.1 parts of polyethylene glycol (PEG) (number average molecular weight: 3000), 0.05 part of antimony trioxide and 0.13 part of trimethyl phosphate. After gradually raising the temperature to 280° C. and reducing the pressure to 0.5 mmHg, the mixture was polymerized under these conditions to obtain a copolymerized polyester.

The copolymerized polyester was melt extruded in a film form from a T-die at 290° C. and quenched on a cooling drum, so that a 660-μm thick unoriented film was obtained. This unoriented film was preheated to 80° C. and stretched 3.2 times in the longitudinal direction and further stretched 3.2 times in the lateral direction, followed by a 30-second heat setting at 210° C. The 65-μm thick biaxially oriented film so obtained was used as the photographic support of the invention.

B. Preparation of Light-sensitive Material

The above photographic support was subjected to corona discharge treatment on both sides at 8 $W/M^2$·min. Then, subbing layer B-3 was formed on one side of the support by coating the following subbing solution B-3 to a dry coating thickness of 0.8 μm, and subbing layer B-4 was formed on the other side of the support by coating the following subbing solution B-4 to a dry coating thickness of 0.8 μm.

| | |
|---|---|
| <Subbing Solution B-3> | |
| Latex comprising a copolymer of 30 wt % butyl acrylate, 20 wt % t-butyl acrylate, 25 wt % styrene, and 25 wt % 2-hydroxyethyl acrylate (30 wt % solid content) | 270 g |
| Compound UL-1 | 0.6 g |
| Hexamethylene-1,6-bis(ethylene urea) | 0.8 g |
| Water as added to | 1,000 ml |
| <Subbing Solution B-4> | |
| Latex comprising a copolymer of 40 wt % butyl acrylate, 20 wt % styrene, and 40 wt % glycidyl acrylate (30 wt % solid content) | 270 g |
| Compound UL-1 | 0.6 g |
| Hexamethylene-1,6-bis(ethylene urea) | 0.8 g |
| Water was added to | 1,000 ml |

After subjecting subbing layers B-3 and B-4 to corona discharge treatment at 8 $W/m^2$·min, subbing layer B-5 was formed on subbing layer B-3 by coating the following subbing solution B-5 to a dry coating thickness of 0.1 μm, and subbing layer B-6 having an antistatic property was formed on subbing layer B-4 by coating the following subbing solution B-6 to a dry coating thickness of 0.8 μm.

| <Subbing Solution B-5> | |
|---|---|
| Gelatin | 10 g |
| Compound UL-1 | 0.2 g |
| Compound UL-2 | 0.2 g |
| Compound UL-3 | 0.1 g |
| Silica particles (average particle size: 3 μm) | 0.1 g |
| Water was added to | 1,000 ml |
| <Subbing Solution B-6> | |
| Water-soluble conductive polymer UL-4 | 60 g |
| Latex comprising compound UL-5 (20% solid content) | 80 g |
| Ammonium sulfate | 0.05 g |
| Hardener UL-6 | 12 g |
| Polyethylene glycol (weight average molecular weight: 600) | 6 g |

-continued

| | |
|---|---|
| Water was added to | 1,000 ml |

The chemical structures of compounds UL-1 to 6 are shown later collectively.

A 25-W/m$^2$·min corona discharge was given to subbing layer B-5, and a 8-W/m$^2$·min corona discharge to subbing layer B-6. Then, multilayered color photographic materials 1 to 5 were prepared by forming the following emulsion layer in sequence on subbing layer B-5, and the following backing layer on subbing layer B-6. The dry thickness of the backing layer was 4.5 μm. The hardener content of the backing layer was controlled so as to give the backing layer having the degree of swelling shown in Table 2.

The amounts of components in the following backing layers, emulsion layers, etc. are per square meter.

| <Backing Layers> | |
|---|---|
| 1st layer: | |
| Gelatin | 4.5 g |
| Sodium-di-(2-ethylhexyl)-sulfosuccinate | 1.0 g |
| Sodium tripolyphosphate | 76 mg |
| Citric acid | 16 mg |
| Carboxyalkyldextran sulfate | 49 mg |
| Hadener H-1 | shown in Table 1 |
| Hadener H-2 | shown in Table 1 |
| 2nd layer: | |
| Gelatin | 1.5 g |
| Polymer beads (average particle size: 3 μm polymethyl methacrylate) | 24 mg |
| Sodium-d-(2-ethylhexyl)-sulfosuccinate | 15 g |
| Carboxyalkyldextran sulfate | 12 mg |
| Hadener H-1 | shown in Table 1 |
| Hadener H-2 | shown in Table 1 |
| <Emulsion Layers, etc.> | |
| 1st layer: antihalation layer HC | |
| Black colloidal silver | 0.15 g |
| UV absorbent UV-1 | 0.20 g |
| Compound CC-1 | 0.02 g |
| High boiling solvent Oil-1 | 0.20 g |
| High boiling solvent Oil-2 | 0.20 g |
| Gelatin | 1.6 g |
| 2nd layer: intermediate layer IL-1 | |
| Gelatin | 1.3 g |
| 3rd layer: low-speed red-sensitive emulsion layer R-L | |
| Silver iodobromide emulsion (average grain size: 0.3 μm, average iodide content: 2.0 mol %) | 0.4 g |
| Silver iodobromide emulsion (average grain size: 0.4 μm, average iodide content: 8.0 mol %) | 0.3 g |
| Sensitizing dye S-1 | $3.2 \times 10^{-4}$ (mol/mol of silver) |
| Sensitizing dye S-2 | $3.2 \times 10^{-4}$ (mol/mol of silver) |
| Sensitizing dye S-3 | $0.2 \times 10^{-4}$ (mol/mol of silver) |
| Cyan coupler C-1 | 0.50 g |
| Cyan coupler C-2 | 0.13 g |
| Colored cyan coupler CC-1 | 0.07 g |
| DIR compound D-1 | 0.006 g |
| DIR compound D-2 | 0.01 g |
| High boiling solvent Oil-1 | 0.55 g |
| Gelatin | 1.0 g |
| 4th layer: high-speed red-sensitive emulsion layer RH | |
| Silver iodobromide emulsion (average grain size: 0.7 μm, average iodide content: 7.5 mol %) | 0.9 g |
| Sensitizing dye S-1 | $1.7 \times 10^{-4}$ (mol/mol of silver) |
| Sensitizing dye S-2 | $1.6 \times 10^{-4}$ (mol/mol of silver) |
| Sensitizing dye S-3 | $0.1 \times 10^{-4}$ (mol/mol of silver) |
| Cyan coupler C-2 | 0.23 g |
| Colored cyan coupler CC-1 | 0.03 g |
| DIR compound D-2 | 0.02 g |
| High boiling solvent Oil-1 | 0.25 g |
| Gelatin | 1.0 g |
| 5th layer: intermediate layer IL-2 | |
| Gelatin | 0.8 g |
| 6th layer: low-speed green-sensitive emulsion layer GL | |
| Silver iodobromide emulsion (average grain size: | 0.6 g |

-continued

| | |
|---|---|
| 0.4 μm, average iodide content: 8.0 mol %) | |
| Silver iodobromide emulsion (average grain size: 0.3 μm, average iodide content: 2.0 mol %) | 0.2 g |
| Sensitizing dye S-4 | $6.7 \times 10^{-4}$ (mol/mol of silver) |
| Sensitizing dye S-5 | $0.8 \times 10^{-4}$ (mol/mol of silver) |
| Magenta coupler M-1 | 0.17 g |
| Magenta coupler M-2 | 0.43 g |
| Colored magenta coupler CM-1 | 0.10 g |
| DIR compound D-3 | 0.02 g |
| High boiling solvent Oil-2 | 0.7 g |
| Gelatin | 1.0 g |
| 7th layer: high-speed green-sensitive emulsion layer GH | |
| Silver iodobromide emulsion (average grain size: 0.7 μm, average iodide content: 7.5 mol %) | 0.9 g |
| Sensitizing dye S-6 | $1.1 \times 10^{-4}$ (mol/mol of silver) |
| Sensitizing dye S-7 | $2.0 \times 10^{-4}$ (mol/mol of silver) |
| Sensitizing dye S-8 | $0.3 \times 10^{-4}$ (mol/mol of silver) |
| Magenta coupler M-1 | 0.30 g |
| Magenta coupler M-2 | 0.13 g |
| Colored magenta coupler CM-1 | 0.04 g |
| DIR compound D-3 | 0.004 g |
| High boiling solvent Oil-2 | 0.35 g |
| Gelatin | 1.0 g |
| 8th layer: yellow filter layer YC | |
| Yellow colloidal silver | 0.1 g |
| Additive HS-1 | 0.07 g |
| Additive HS-2 | 0.07 g |
| Additive SC-1 | 0.12 g |
| High boiling solvent Oil-2 | 0.15 |
| Gelatin | 1.0 g |
| 9th layer: low-speed blue-sensitive emulsion layer BL | |
| Silver iodobromide emulsion (average grain size: 0.3 μm, average iodide content: 2.0 mol %) | 0.25 g |
| Silver iodobromide emulsion (average grain size: 0.4 μm, average iodide content: 8.0 mol %) | 0.25 g |
| Sensitizing dye S-9 | $5.8 \times 10^{-4}$ (mol/mol of silver) |
| Yellow coupler Y-1 | 0.6 g |
| Yellow coupler Y-1 | 0.32 g |
| DIR compound D-1 | 0.003 g |
| DIR compound D-2 | 0.006 g |
| High boiling solvent Oil-2 | 0.18 g |
| Gelatin | 1.3 g |
| 10th layer: high-speed blue-sensitive emulsion layer BH | |
| Silver iodobromide emulsion (average grain size: 0.8 μm, average iodide content: 8.5 mol %) | 0.5 g |
| Sensitizing dye S-10 | $3 \times 10^{-4}$ (mol/mol of silver) |
| Sensitizing dye S-11 | $1.2 \times 10^{-4}$ (mol/mol of silver) |
| Yellow coupler Y-1 | 0.18 g |
| Yellow coupler Y-2 | 0.10 g |
| High boiling solvent Oil-2 | 0.05 g |
| Gelatin | 2.0 g |
| 11th layer: 1st protective layer PRO-1 | |
| Silver iodobromide (average grain size: 0.08 μm) | 0.3 g |
| UV absorbent UV-1 | 0.07 g |
| UV absorbent UV-2 | 0.10 g |
| Additive HS-1 | 0.2 g |
| Additive HS-2 | 0.1 g |
| High boiling solvent Oil-1 | 0.07 g |
| High boiling solvent Oil-3 | 0.07 g |
| Gelatin | 0.8 g |
| 12th layer: 2nd protective layer PRO-2 | |
| Compound A | 0.04 g |
| Compound B | 0.004 g |
| Polymethyl methacrylate (average particle size: 3 μm) | 0.02 g |
| Methyl methacrylate:ethyl methacrylate:methacrylic acid 3:3:4 (weight ratio) copolymer (average particle size: 3 μm) | 0.13 g |
| Gelatin | 0.7 g |

Preparation of Silver Iodobromide Emulsion

The silver iodobromide emulsion used in the 10th layer was prepared by the double-jet method, using monodispersed silver iodobromide grains having an average grain size of 0.33 μm and a silver iodide content of 2 mol % as seed grains; details of the procedure were as follows: While stirring the following solution G-1 under conditions of 70° C., pAg 7.8 and pH 7.0, 0.34 mol of the seed emulsion was added thereto.

(Formation of Inner High Iodide Content Phase-Core Phase)

Then, the following solutions H-1 and S-1 were added, while keeping the flow ratio at 1:1, in 86 minutes at an accelerated flow rate (the final flow rate was 3.6 times the initial flow rate).

Formation of Outer Low Iodide Content Phase-Shell Phase

Subsequently, the following solutions H-2 and S-2 were added at a flow ratio of 1:1 in 65 minutes, under conditions of pAg 10.1 and pH 6.0, while accelerating the flow rate so as to make the final flow rate 5.2 times the initial flow rate.

During grain formation, the pAg and pH were controlled with an aqueous solution of potassium bromide and an aqueous solution of 56% acetic acid. The resulting silver halide grains were desalted according to the usual flocculation method and redispersed with the addition of gelatin to give an emulsion, which was then adjusted to pH 5.8 and pAg 8.06 at 40° C.

The emulsion thus obtained was a monodispersed emulsion comprising octahedral silver iodobromide grains having an average grain size of 0.80 μm, a grain size distribution extent of 12.4% and a silver iodide content of 8.5 mol %.

| | |
|---|---|
| Solution G-1 | |
| Ossein gelatin | 100.0 g |
| 10 wt % methanol solution of the following compound-I | 25.0 ml |
| 28% aqueous ammonia | 440.0 ml |
| 56% aqueous acetic acid solution | 660.0 ml |
| Water was added to | 5,000.0 ml |
| Solution H-1 | |
| Ossein gelatin | 82.4 g |
| Potassium bromide | 151.6 g |
| Potassium iodide | 90.6 g |
| Water was added to | 1,030.5 ml |
| Solution S-1 | |
| Silver nitrate | 309.2 g |
| 28% Aqueous ammonia | equivalent |

-continued

| | |
|---|---|
| Water was added to | 1,030.5 ml |
| Solution H-2 | |
| Ossein gelatin | 302.1 g |
| Potassium bromide | 770.0 g |
| Potassium iodide | 33.2 g |
| Water was added to | 3,776.8 ml |
| Solution S-2 | |
| Silver nitrate | 1,133.0 g |
| 28% Aqueous ammonia | equivalent |
| Water was added to | 3,776.8 ml |

*Compound-I: sodium polypropyleneoxy-polyethyleneoxy-di-succinate

The silver iodobromide emulsions used in the emulsion layers other than the 10th layer were prepared in the same way so as to give different average grain sizes and silver iodide contents, by varying the average grain size of seed grains, temperature, pAg, pH, flow rate, addition time and halide composition.

Each of these emulsions, which were monodispersed emulsions comprised core/shell type grains having a distribution extent not more than 20%, was optimally chemically ripened in the presence of sodium thiosulfate, chloroauric acid and ammonium thiocyanate. Then, sensitizing dyes, 4-hydroxy-6-methyl-1,3,3a,7-tetrazaindene and 1-phenyl-5-mercaptotetrazole were added thereto.

In addition to the above components, photographic light-sensitive materials 1 to 5 contained compounds Su-1 and Su-2, thickener, hardeners H-1 and H-2, stabilizer ST-1, antifoggants AF-1 and AF-2 (weight average molecular weights were 10,000 and 1,100,000, respectively), dyes AI-1 and AI-2, and compound DI-1 (9.4 mg/m$^2$).

The chemical structures of the compounds used in the above light-sensitive materials were as follows:

UL-1

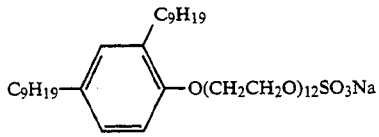

UL-2

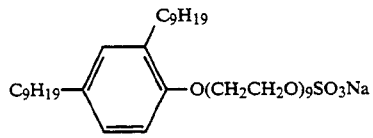

UL-4

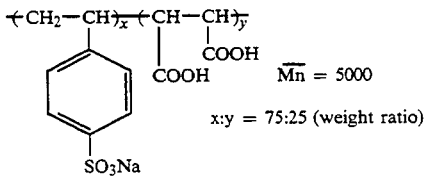

UL-5

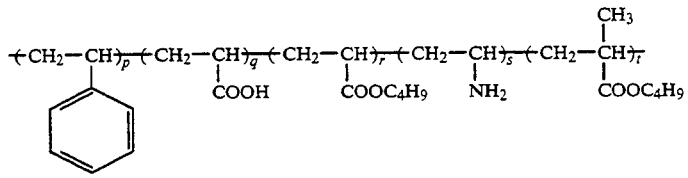

a mixture of

-continued
UL-6
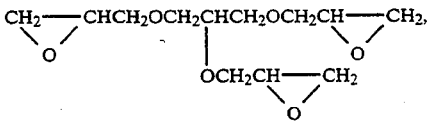
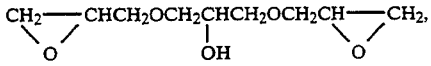
and
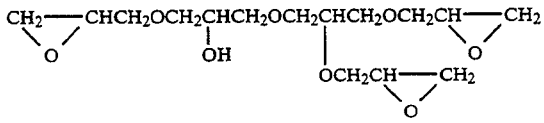
C-1
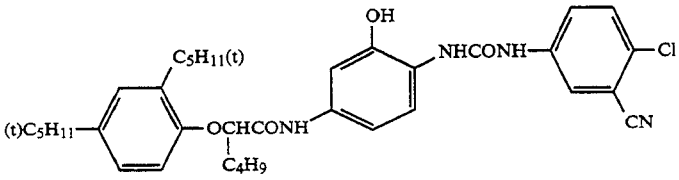
C-2
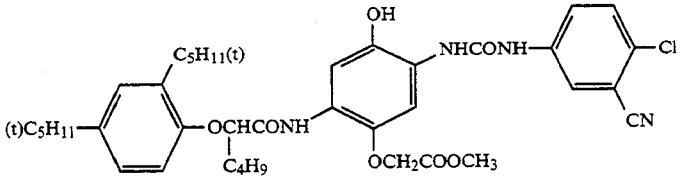
M-1
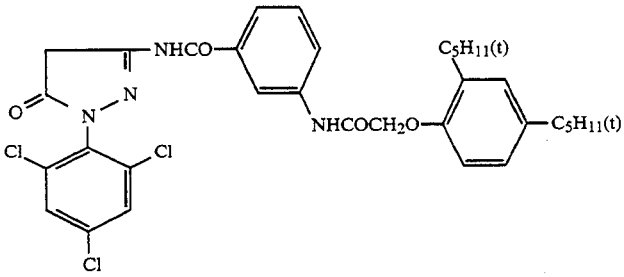
M-2
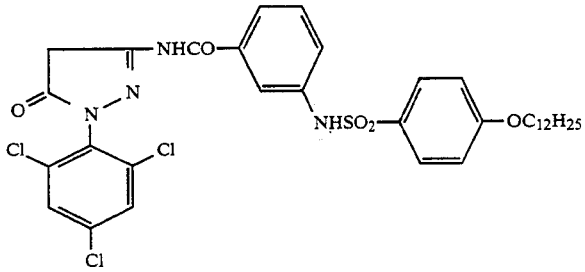
Y-1
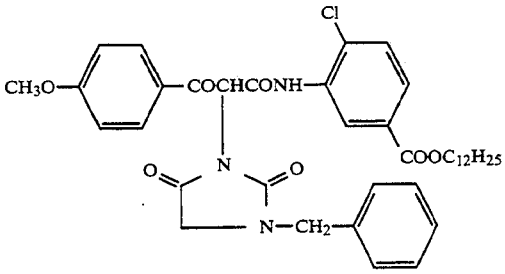

-continued
Y-2
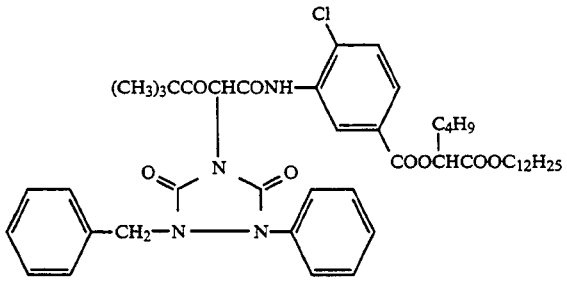
CC-1
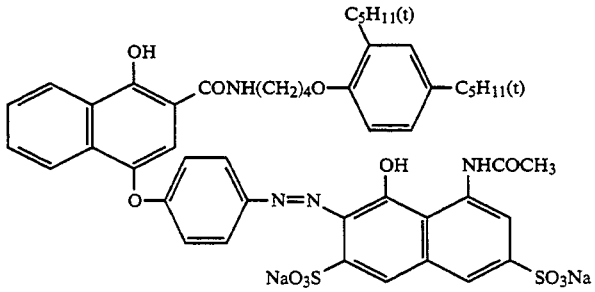
CM-1
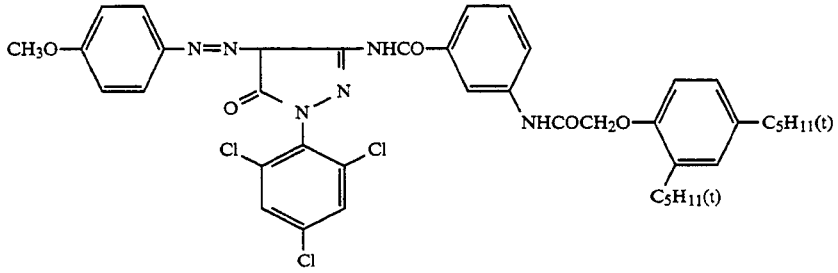
D-1
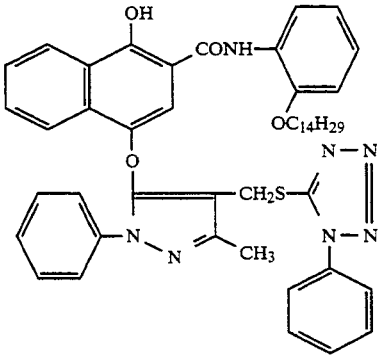
D-2
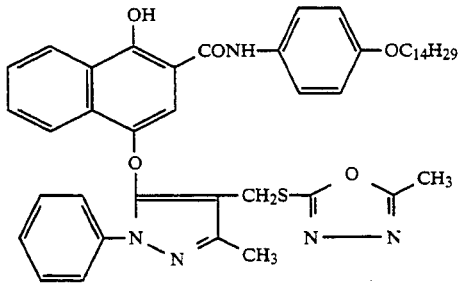

-continued
D-3
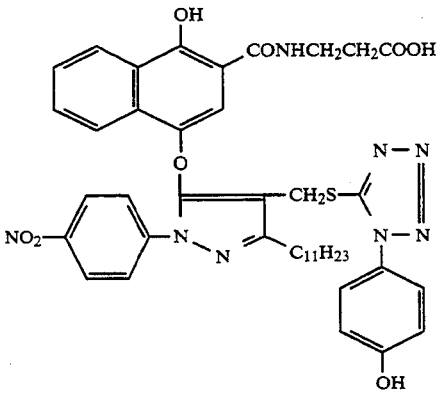
UV-1
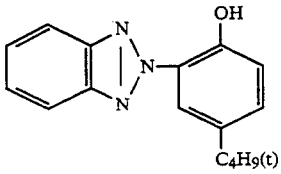
UV-2
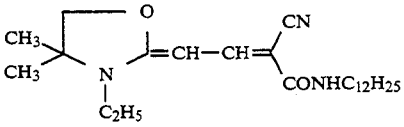
S-1
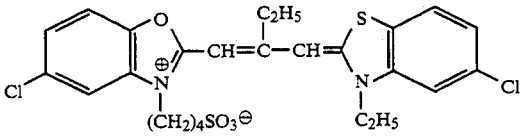
S-2
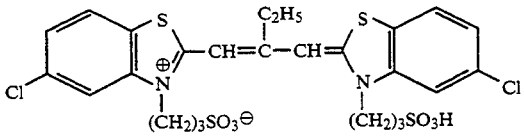
S-3
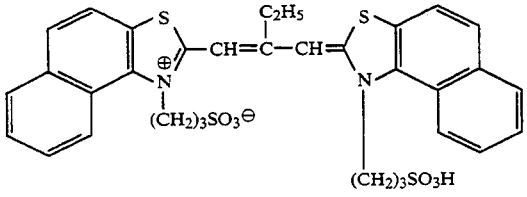
S-4
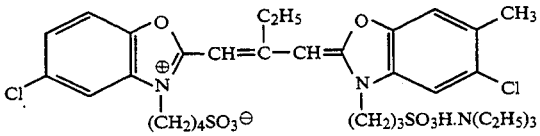
S-5
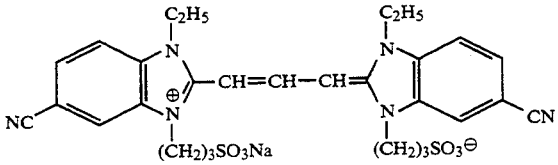

-continued
S-6
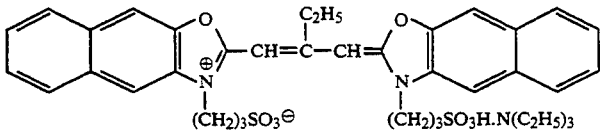
S-7
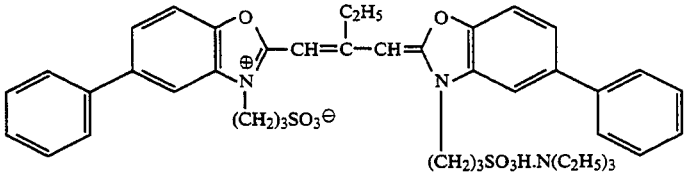
S-8
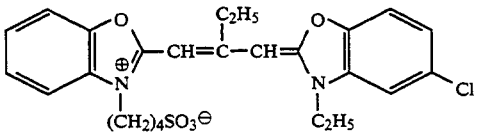
S-9
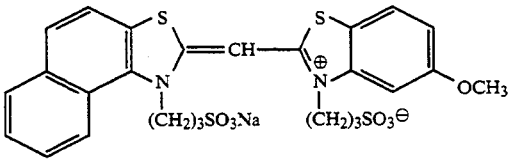
S-10
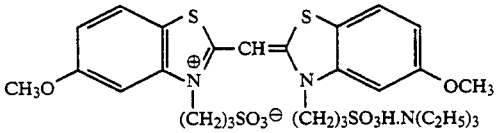
S-11
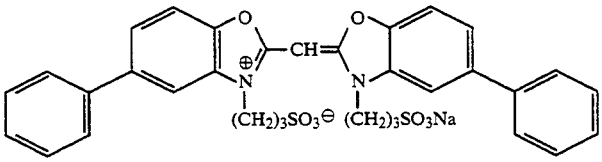
HS-1
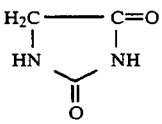
HS-2
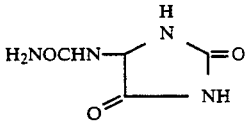
SC-1
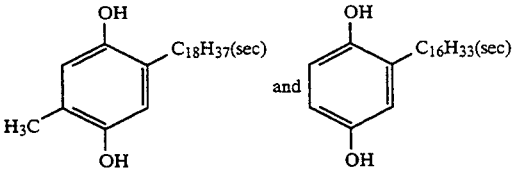
(mixture of 2:3)
Oil-1
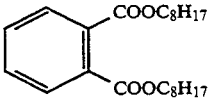

-continued
Oil-2
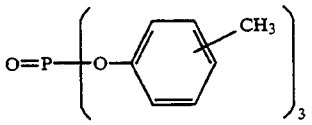
Oil-3
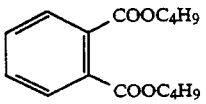
H-1
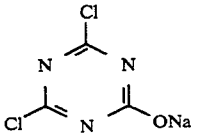
H-2
$(CH_2{=}CHSO_2CH_2)_2O$
SU-1
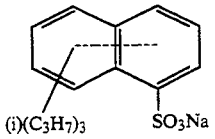
SU-2
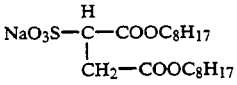
Compound A
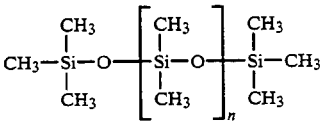
weight average molecular weight = 30,000
Compound B
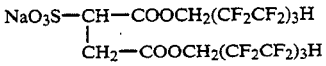
(A mixture of the following three components)
DI-1
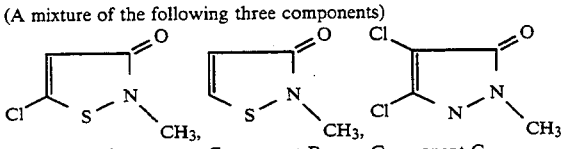
Component A Component B Component C
component A: component B: component C = 50:46:4 (mole ratio)
AI-1
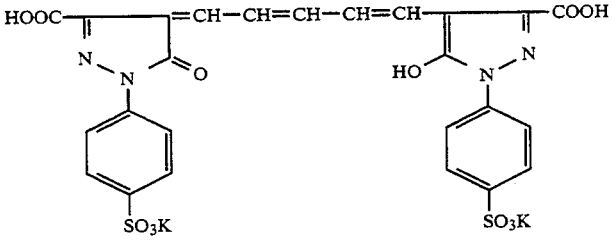
AI-2
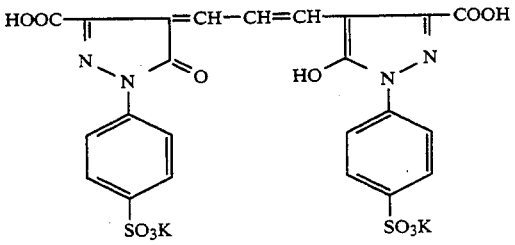

-continued

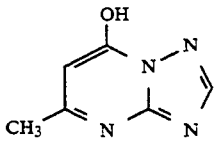

ST-1

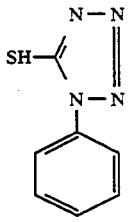

AF-1

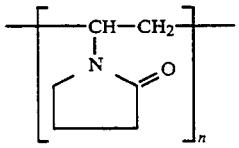

AF-2

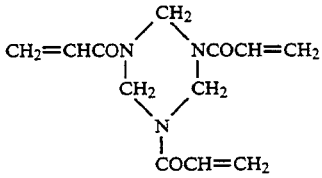

UL-3

Method of Evaluation

Photographic light-sensitive materials 1 to 5 were evaluated as described below. The results are shown in Table 2.

Degree of Swelling

The degree of swelling is obtained by the following equation:

$$\textit{Degree of swelling} = [\,(A - C) / (B - C)\,] \times 100$$

wherein A is the weight (in grams) of 10 $cm^2$ of the photographic light sensitive material after (i) adhering water-proof tape on the backing layer, (ii) removing the silver halide emulsion layer with a bleaching agent, (iii) peeling off the water-proof tape, (iv) conditioning the resulting material at 23° C. and 55% RH for 1 day, (v) dipping the conditioned material in color developer at 38° C. for 3 minutes, and (vi) wiping off the color developer from the material; B is the weight of the material after further conditioning at 23° C. and 55% RH for 1 day; and C is the weight of the material after removing the backing layer with a bleaching agent and further conditioning the resulting material at 23° C. and 55% RH for 1 day, the bleaching agent being an aqueous sodium hypochlorite solution (Bright manufactured by Lion Co. Ltd. twenty times diluted with water) and the color developer being a solution of 800 ml of water, 30 g of potassium, 2.5 g of sodium hydrogen carbonate, 1.3 g of sodium bromide, 1.2 mg of potassium iodide, 2.5 g of ethyl-N-(-hydroxyethyl)aniline sulfuric acid, 3 g of diethylenetriamine-pentaacetic acid and 1.2 g of potassium hydroxide to which water was added to 1 liter and adjusted to pH 10.06.

Stain

Photographic light-sensitive materials 1 to 5 were each processed in a cine automatic processor NCV-60 (made by Noritsu Koki Co.). The degree of stain was examined for each processed light-sensitive material by knowing the percentage of the backing layer's stained portion in a 117-cm long film specimen.

A: less than 1%
B: 1% to less than 10%
C: 10% to less than 50%
D: 50% to less than 100%

Class B and A are acceptable for practical use.

TABLE 1

| | Backing layer | Hardener added (mg) H-1 | H-2 | Light-sensitive Material |
|---|---|---|---|---|
| Example 1 | First layer | 112 | 157 | 1 |
| | Second layer | 38 | 53 | |
| Example 2 | First layer | 68 | 144 | 2 |
| | Second layer | 23 | 48 | |
| Example 3 | First layer | 58 | 86 | 3 |
| | Second layer | 20 | 29 | |
| Comparative Example 1 | First layer | 50 | 9 | 4 |
| | Second layer | 17 | 3 | |
| Comparative Example 2 | First layer | 22 | 90 | 5 |
| | Second layer | 8 | 30 | |

TABLE 2

| | Degree of Swelling (%) | Stain | Light-sensitive Material |
|---|---|---|---|
| Example 1 | 150 | A | 1 |
| Example 2 | 185 | A | 2 |
| Example 3 | 230 | B | 3 |
| Comparative Example 1 | 260 | C | 4 |
| Comparative | 310 | D | 5 |

TABLE 2-continued

| | Degree of Swelling (%) | Stain | Light-sensitive Material |
|---|---|---|---|
| Example 2 | | | |

What is claimed is:

1. A silver halide color photographic light-sensitive material in roll form comprising a support, and provided thereon, a silver halide emulsion layer and, on the side of the support opposite the silver halide emulsion layer, a backing layer containing gelatin and a hardener, the backing layer having a degree of swelling of 250% or less represented by the following equation:

$$\textit{Degree of swelling} = [\,(A - C) / (B - C)\,] \times 100$$

wherein A is the weight (in grams) of 10 $cm^2$ of the photographic light sensitive material after (i) adhering water-proof tape on the backing layer, (ii) removing the silver halide emulsion layer with a bleaching agent, (iii) peeling off the water-proof tape, (iv) conditioning the resulting material at 23° C. and 55% RH for 1 day, (v) dipping the conditioned material in a color developer at 38° C. for 3 minutes, and (vi) wiping off the color developer from the material; B is the weight of the material after further conditioning at 23° C. and 55% RH for 1 day; and C is the weight of the material after removing the backing layer with a bleaching agent and further conditioning the resulting material at 23° C. and 55% RH for 1 day.

2. The material of claim 1, wherein the hardener is selected from the group consisting of a vinylsulfone and a s-triazine.

3. The material of claim 2, wherein the content of the vinylsulfone is 25 mg or more per 1 g of gelatin.

4. The material of claim 2, wherein the content of the s-triazine is 15 mg or more per 1 g of gelatin.

5. The material of claim 1, wherein the backing layer is comprised of two backing layers containing gelatin and a hardener.

6. The material of claim 1, wherein the thickness of the backing layer is 0.1 to 15 μm.

7. The material of claim 5, wherein a ratio of the thickness of an upper backing layer to a lower backing layer is 1:5 to 5:1.

8. The material of claim 1, wherein the thickness of the support is 50 to 110 μm.

9. The material of claim 1, wherein the support is composed of a polyester.

10. The material of claim 2, containing s-triazine in an amount of at least 15 mg per gram of gelatin.

11. The material of claim 1 wherein said support is of polyester.

* * * * *